US007944417B2

(12) United States Patent
Ishimoto et al.

(10) Patent No.: US 7,944,417 B2
(45) Date of Patent: May 17, 2011

(54) DISPLAY DEVICE AND METHOD OF DISPLAYING IMAGE

(75) Inventors: Seiichirou Ishimoto, Fukuoka (JP); Naoya Kimura, Chiba (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 775 days.

(21) Appl. No.: 12/010,257

(22) Filed: Jan. 23, 2008

(65) Prior Publication Data

US 2008/0186258 A1 Aug. 7, 2008

(30) Foreign Application Priority Data

Feb. 5, 2007 (JP) ..... 2007-025033

(51) Int. Cl.
*G09G 3/30* (2006.01)

(52) U.S. Cl. ..... 345/77; 345/204

(58) Field of Classification Search ..... 345/204–206, 345/690, 691, 211, 212, 76, 77, 78, 82, 84, 345/208; 315/169.1, 169.3
See application file for complete search history.

(56) References Cited

U.S. PATENT DOCUMENTS

| | | | | |
|---|---|---|---|---|
| 4,823,121 | A * | 4/1989 | Sakamoto et al. | 345/78 |
| 6,894,666 | B2 * | 5/2005 | Otawara et al. | 345/77 |
| 7,474,288 | B2 * | 1/2009 | Smith et al. | 345/83 |
| 7,755,580 | B2 * | 7/2010 | Mas et al. | 345/82 |

FOREIGN PATENT DOCUMENTS

JP 2000-107004 A 4/2005

* cited by examiner

*Primary Examiner* — Regina Liang
*Assistant Examiner* — Tom V Sheng
(74) *Attorney, Agent, or Firm* — Rabin & Berdo, P.C.

(57) ABSTRACT

A display device includes a controller detecting a black line, in which all light emitting diodes in one line are non-luminescence, counting a number of times (S) that display data indicating the black line is sent to the display panel in serial, halting a scanning operation to the display data indicating the black line, applying the time period for halting the scanning operation to another time period for displaying display data, which are next to the display data indicating the black line and which is not the display data indicating the black line, whereby the another time period for displaying display data is set to "S+1" times longer than a stipulated time period, and sending a control signal to a column driver, which controls the column driver to set a drive current or voltage applied from a power source to a 1/(S+1) of the stipulated value for the "S+1" time period.

4 Claims, 4 Drawing Sheets

| LINE NO. (SL) | DISPLAY OR NOT | DISPLAY LINE (DL) | DRIVE CURRENT (DI) |
|---|---|---|---|
| 1 | 1 | 1 | 1 |
| 2 | 0 | 4 | 1 / 3 |
| 3 | 0 | 4 | 1 / 3 |
| 4 | 1 | 4 | 1 / 3 |
| 5 | 1 | 5 | 1 |
| 6 | 0 | 7 | 1 / 2 |
| 7 | 1 | 7 | 1 / 2 |
| ⋮ | ⋮ | ⋮ | ⋮ |
| m | 1 | m | 1 |

FIG 3

DISPLAY DEVICE AND METHOD OF DISPLAYING IMAGE

CROSS-REFERENCE TO RELATED APPLICATION

This application claims the priority benefit of Japanese Patent Application No. 2007-025033, filed Feb. 5, 2007, the entire disclosure of which is incorporated herein by reference.

BACKGROUND OF THE INVENTION

1. Field of the Invention

The invention relates to a display device in a passive matrix structure, which has light emitting diodes such as an organic electroluminescence and a method of displaying an image by using the display device, and specifically relates to a display device having a long product-lifetime and a method of display an image by using the display device.

2. Description of the Related Art

A display device 200 in the related art is shown in FIG. 2. The display device includes an organic panel 1 in which a plurality of light emitting diodes E11~Emn are formed at each intersection of cathode rays R1~Rm and anode rays C1~Cn. Thus, a cathode and an anode of each light emitting diode E11~Emn are connected to one of the cathode rays R1~Rm and the anode rays C1~Cn, respectively. Each light emitting diode E11~Emn produces luminescence by a drive current, which flows from its anode to its cathode. The display device 200 includes a row driver 2 and a column driver 3, which drive the organic panel 1.

The row driver 2 selectively drives one or some of the cathode rays R1~Rm periodically with constant interval in the numerical order. The row driver 2 includes a plurality of row switches RS1~RSm, each of which corresponds to one of the cathode rays R1~Rm, and the cathode rays R1~Rm are connected to the ground GND by the operation of the row switches RS1~RSm in response to a timing signal for scanning.

The column diver 3 drives one or some of the anode rays C1~Cn of the organic panel 1 in response to data to be displayed (hereinafter called display data). The column diver 3 includes power sources I1~In supplying a constant drive current, each of which corresponds to one of the anode rays C1~Cn and column switches CS1~CSn, each of which turns on/off in response to the display data DT. Thus, when the column switch CS1 turns on and the other column switches CS2~CSn turns off, only the drive current from the power source I1 is supplied to the anode ray C1. The timing signal for scanning to the row driver 2 and the displayed data to the column driver are provided from a control circuit 4.

The control circuit 4 includes an image data receiving circuit 4*a*, a memory 4*b* and a timing controller 4*c*. The image data receiving circuit 4*a* receives an image data IN for displaying, and sends the image data to the memory 4*b*. The memory 4*b* stores the image data. The timing controller 4*c* accesses the memory 4*b* to read out the image data with a constant timing, and send the timing signal to the row driver 2 and the display data to the column driver 3, respectively.

Thus, the display device 200 stores the image data at the memory 4*b* after the image data IN inputted from an unillustrated external device is inputted at the image data receiving circuit 4*a*. Based on the image data IN stored in the memory 4*b*, the timing controller 4*c* generates the displayed data and the timing signal for scanning, and controls the row switches RS1~RSm in the row driver 2 and the column switches CS1~CSn in the column driver 3.

In response to the timing signal from the timing controller 4*c*, the row driver 2 selectively drives one or more of the cathode rays R1~Rm periodically with constant interval in the numerical order, as described above. Thus, the electric potential of the selected anode ray(s) is pulled to the ground GND via the selected row switch(es) RS1~RSm. Further, as descried above, since the timing controller 4*c* controls the column switches CS1~CSn in response to the displayed data and in synchronization with the scanning period of the row switches RS1~RSm, it is possible to supply the drive current to the desired light emitting diodes, selectively.

For example, in the case that the light emitting diodes E11 and E12 produce luminescence, the row driver 2 is scanned in order to turn only the row switch RS1 on so that the electric potential of the anode ray R1 is pulled to the ground GND. Concurrently, the cathode rays C1 and C2 are connected to the power sources 11 and 12 by turning the column switches CS1 and CS2 on. According to this operation, the drive current is supplied to the light emitting diodes E11 and E12, and thus, they produce luminescence.

The luminosity of each the light emitting diodes E11 and E12 is the same because the same drive current is applied to both light emitting diodes E11 and E12. However, it is known to control the luminosity that human feels by utilizing the residual image phenomenon of the human eyes while the same drive current is applied. Changing the time period for supplying the drive current, which is a time period that the column switches CS1 and CS2 turns on during one scanning period, makes this possible. By repeating such scanning operations and driving operations, the image is displayed on the organic EL panel 1.

The Japanese Patent publication Reference JP 2005-107004A discloses a driving device for an organic EL panel in an active matrix structure, which has a low power consumption characteristic by halting an operation of a driving circuit when the display data of a single line indicate all non-luminescence.

The driving device disclosed in JP 2005-107004 A includes a source driver, a gate driver and a control unit for driving the organic EL panel in the active matrix structure. In the driving device, when all displayed data in a single scanning period indicate non-luminescence (ex. Data "0"), the control unit sends an all-zero notice to the source driver. Once the source driver receives the all-zero notice from the control unit, it is compelled to output the black data to each pixel disposed in the organic EL panel. As a result, the operation of the driving circuit is halted. Since the operation of the source driver, which performs high speed operation by a relatively high driving voltage, is temporally halted at the time that all displayed data in a single scanning period indicate non-luminescence, the low power consumption can be expected.

However, in such a display device in the related art, the cathode rays R1~Rm, which act as scanning lines, are driven by the timing signal whose duty ratio is 1/m ("m" is the number of the cathode rays) in each scanning period. Thus, in order to obtain the displayed luminance Ld required for the display panel, each light emitting diode should produces luminescence with the displayed luminance "Ld×m" when the corresponding cathode ray is driven. For this reason, even the displayed luminance Ld stays constant, it is required to increase the luminescence intensity at each light emitting diode when the number of the scanning lines is increased, that is, when the duty ration 1/m gets smaller. Thus, the drive current to the light emitting diodes also increase in proportion to the increase of the number of the scanning lines.

However, the product-lifetime of the organic EL panel comes under the influence of the amount of the drive current passing though the light emitting diodes. If the amount of the drive current is doubled, the product-lifetime of the organic EL panel may be less than half, such as quarter. Thus, according to the display device in the related art, when the display device displays the image with a contestant luminance, the more the number of the scanning lines increases and the less the duty ration 1/m decreases, the sooner the product-lifetime of the display device is over. The deterioration of the luminance proceeds remarkably with time.

SUMMARY OF THE INVENTION

An objective of the invention is to solve the above-described problem and to provide a display device having a long product-lifetime and a method of display an image by using the display device.

The objective is achieved by a display device including a display panel having a passive matrix structure having a plurality of cathode rays, which are disposed in parallel, a plurality of anode rays which are disposed in parallel and are perpendicular to the cathode rays and a plurality of light emitting diodes disposed at each intersection of the cathode and anode rays, the display panel producing luminescence by the electric current flowed from each anode ray to a selected cathode ray via the light emitting diodes, a memory storing image data inputted, which includes a plurality of display data, each of which indicates one-line image data of the image data, and outputting one of the display data to be displayed at the display panel, the display data corresponding to one of the cathode rays, a column driver supplying drive current or voltage having a stipulated value or the less from power sources, which are commonly controlled by a control signal, to one or more anode rays, which are intended to be activated in response to the display data outputted from the memory, a row driver connecting one of the cathode rays, which is designated by the display data, to a power supply voltage, and a controller detecting a black line, in which all light emitting diodes in one line are non-luminescence, counting a number of times (S) that the display data indicating the black line is sent to the display panel in serial, halting a scanning operation to the display data indicating the black line, applying the time period for halting the scanning operation to another time period for displaying display data, which are next to the display data indicating the black line and which is not the display data indicating the black line, whereby the another time period for displaying display data is set to "S+1" times longer than a stipulated time period, and sending the control signal to the column driver, which controls the column driver to set the drive current or voltage applied from the power source to a 1/(S+1) of the stipulated value for the "S+1" time period.

BRIEF DESCRIPTION OF THE DRAWINGS

The invention will be more particularly described with reference to the accompanying drawings, in which:

FIG. 3 is a display control table used in the display device shown in FIG. 1.

DETAILED DESCRIPTION OF THE PREFERRED EMBODIMENTS

The preferred embodiment of the invention is explained together with drawings as follows. In each drawing, the same reference numbers designate the same or similar components.

Figure 1:
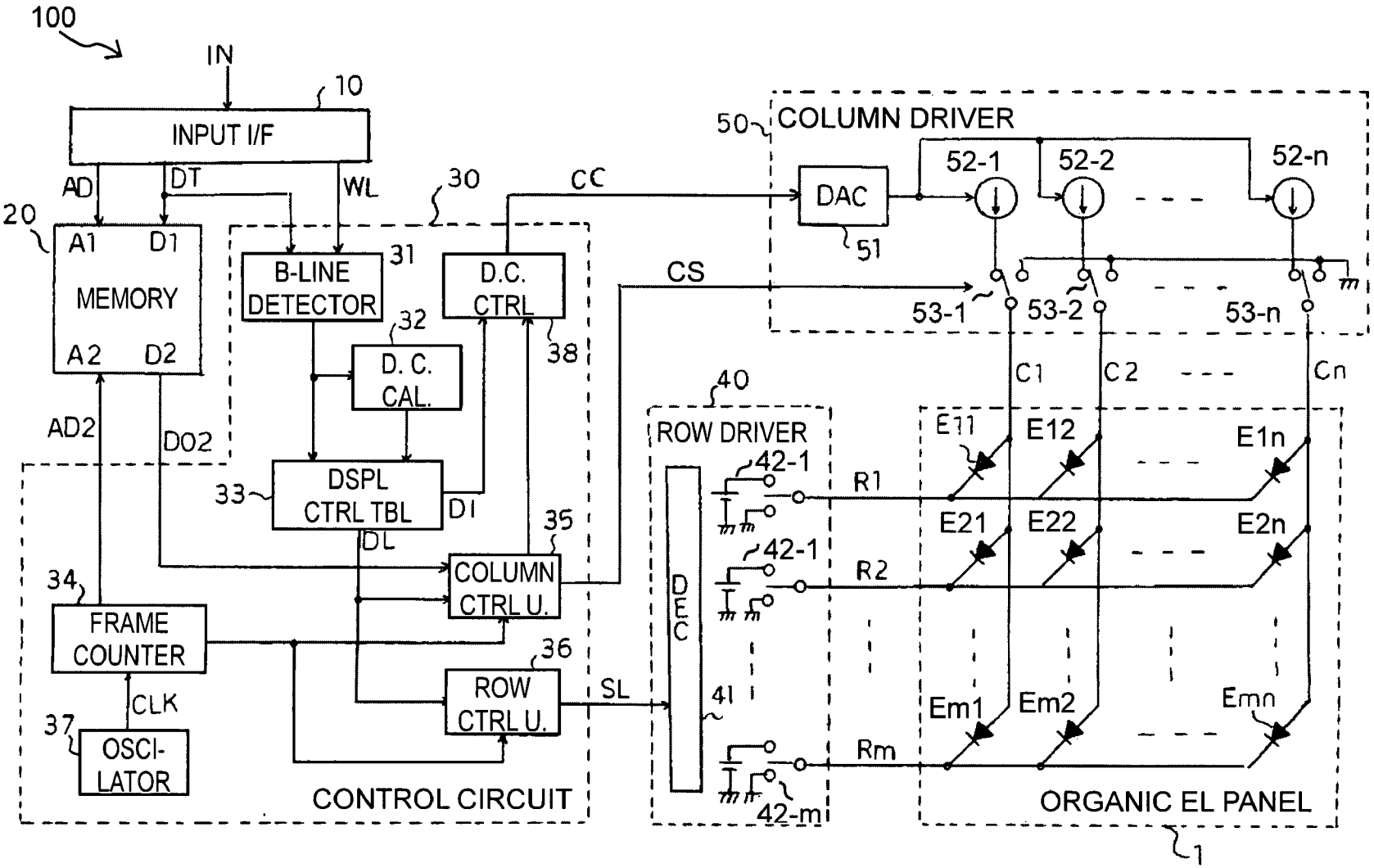
FIG. 1 is a circuit diagram of a display device, according to the preferred embodiment.
Figure 2:
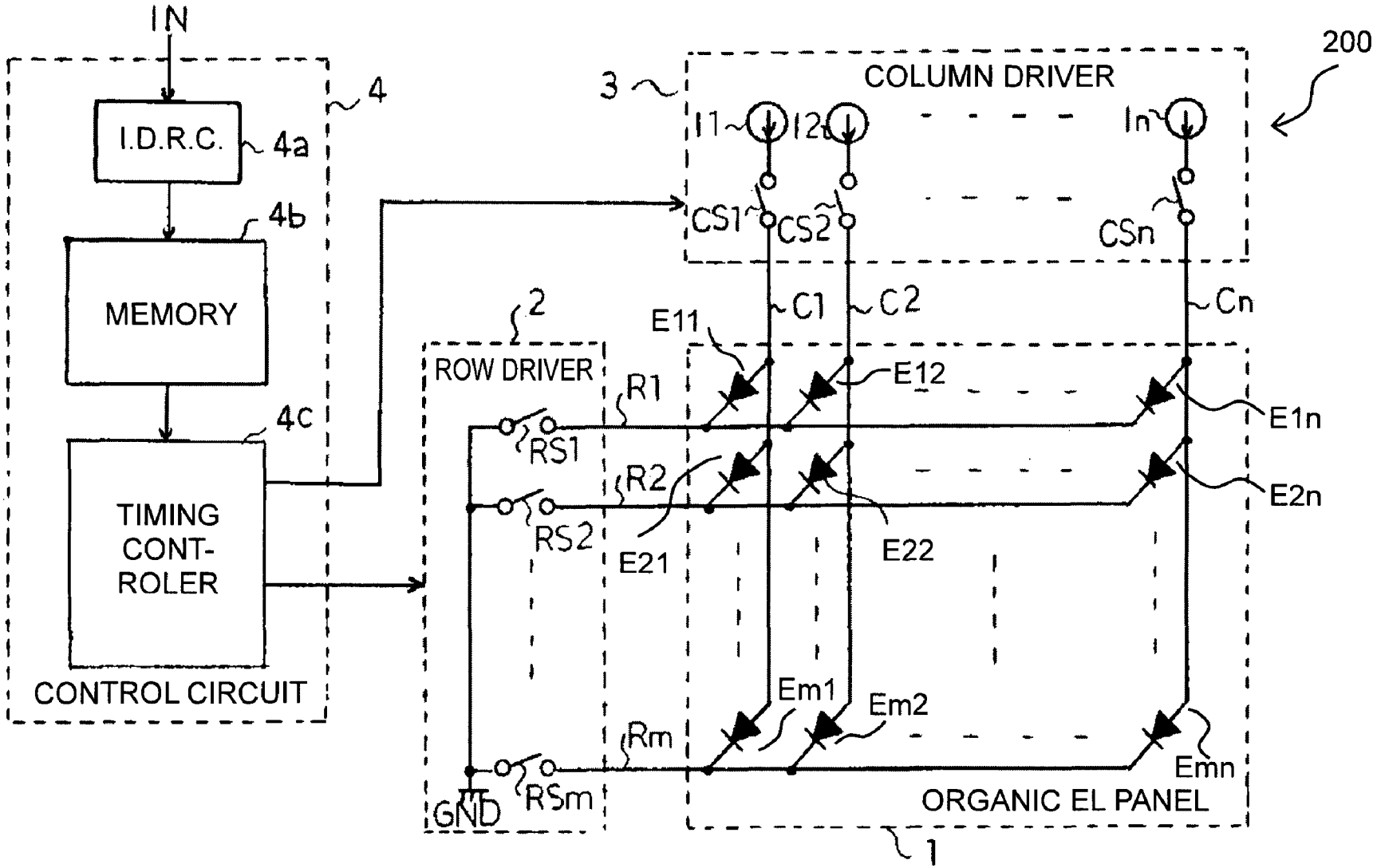
FIG. 2 is a circuit diagram of a display device in the related art.

FIG. 1 is a circuit diagram of an organic electroluminescence (EL) display device 100, according to the preferred embodiment. The organic EL display device 100 includes an organic EL panel 1, an input interface (hereinafter called an input I/F) 10, a memory 20, a control circuit 30, a row driver 40 and a column driver 50.

The organic EL panel 1 in a passive matrix structure includes a plurality of light emitting diodes E1~Emn, each of which is formed at one of the intersections of cathode rays R1~Rm and anode rays C1~Cn. Thus, a cathode and an anode of each light emitting diode E11~Emn are connected to ones of the cathode rays R1~Rm and the anode rays C1~Cn, respectively. Each light emitting diodes E11~Emn produces luminescence by a drive current, which flows from its anode to its cathode.

The input I/F 10 receives image data IN supplied sequentially and periodically from an external device, and outputs a display data DT indicating the one-line image data, an address AD indicating the location in the memory 20 where a display data DT are stored, and a writing line number WL indicating the line number, which corresponds to the one-line image data. The display data DT and the address AD are sent to the memory 20, and the writing line number WL is sent to the control circuit 30 together with the display data DT.

The memory 20, which stores a screen image by each frame, includes two ports, and thus, it stores one frame having a plurality of the display data DT. The display data DT and the address AD are inputted to terminals D1 and A1 of the first port, respectively. The memory 20 outputs one-line image data DO2 to the control circuit 30 from its terminal D2 of the second port in response to a control address AD2 applied to a terminal A2 of the second port from the control circuit 30.

The control circuit 30 detects a line, which indicates that the display data DT shows non-luminescence (ex. all data in the line indicates "0") at all pixels in one line. Such a non-luminescence line is called a black line. When the control circuit 30 detects the black line, the scanning operation to the black line is halted for a particular period. The control circuit 30 applies the time period for halting to another time period for displaying a line, which is next to the black line, and which is not the black line.

The control circuit 30 includes a black line detector 31, which detects whether or not the display data DT associated with the writing line number WL, which is sent from the input I/F 10, is the black line. The detection result by the black line detector 31 is inputted to a drive current calculator 32 and a display control table 33. When the black line is detected, the drive current calculator 32 determines another line number for the one-line image data to be displayed in response to the halt of the scanning operation to the black line, calculates an amount of a drive current to the one-line image data having the another line number, and sends and writes such control information to the display control table 33. The display control table 33 latches the location of the black line corresponding to the display data DT memorized in the memory 20, and also holds the control information sent from the drive current calculator 32.

The control circuit 30 further includes a row control unit 36, a column control unit 35 and a drive current control unit 38. The row control unit 36 controls the row driver 40 in response to display-line information DL held in the display control table 33. The column control unit 35 controls the column driver 50 in response to the one-line image data DO2 outputted from the memory 20. The drive current control unit 38 outputs a drive current control signal CC to the column driver in response to the drive current control information DI held in the display control table 33 and the timing signal outputted from the column control unit 35.

The control circuit further includes a frame counter 34 and an oscillator 37. The frame counter 34 generates kinds of timing signals, each of which is a standard necessary for displaying the image, in response to a clock signal CLK outputted from the oscillator 37. The row control unit 36 and the column control unit 35 are operated in response to the timing signals generated by the frame counter 34.

In response to the scanning line number SL outputted from the row control unit 36, the row driver 40 connects one or more cathode rays R1~Rm, which correspond to the scanning line number SL, to the ground GND. The row driver 40 includes a decoder 41 for decoding the scanning line number SL and a plurality of row switches 42-1~**42-*m* for controlling the connection between the cathode rays R1**~Rm and the ground GND.

The column driver drives one or more cathode rays C1~Cm of the organic EL panel 1 in response to a control signal CS, which is generated from the display data DT read out from the memory 20. The column driver includes a digital-analog converter (DAC) 51, a plurality of power sources 52-1~**52-*n*, and a plurality of column switches 53-1~53-*n*. The DAC 51 converts the drive current control signal CC in the digital signal form outputted from the control circuit 30 to an analog signal. The power sources 52-1~52-*n*, each of which corresponds to one of the anode rays C1~Cn, supply constant a drive current in response to the analog signal from the DAC 51. The column switches CS1~CSn, control the connection of the power sources 52-1~52-*n* and the anode rays C1~Cn in response to the control signal CS. As described above, the control signal CS is generated from the display data DT stored in the memory 20. The display data DT inputted from the input I/F 10 is inputted to the column control unit 35 via the memory 20 as the one-line image data DO2, and the luminance information, which is the content of the display data DT, is converted by the column control unit 35 to the time information indicating the period for turning the column switch on. As a result, each of the column switches 52-1~52-*n*** is controlled by the control signal CS.

Figure 4:
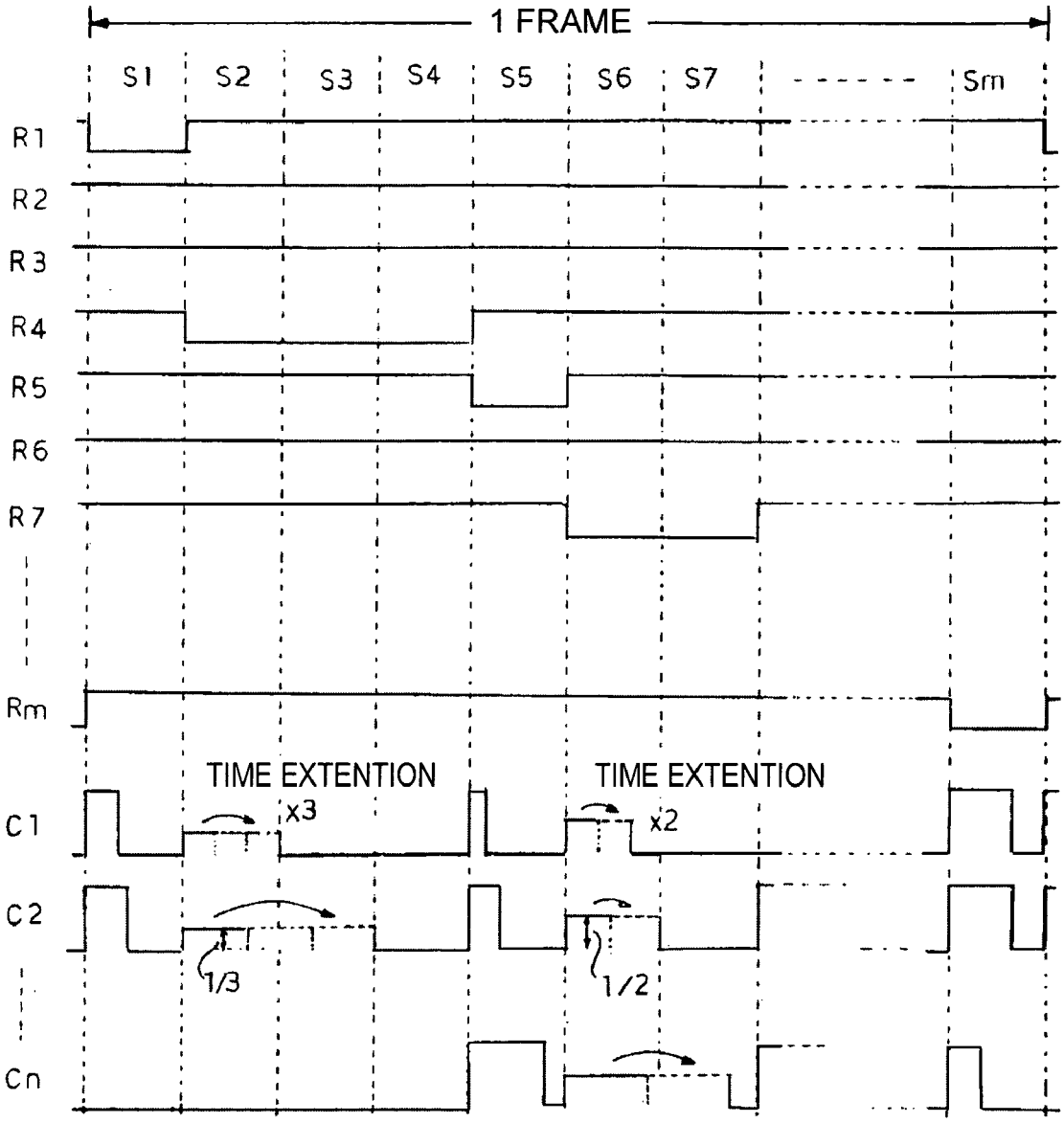
FIG. 4 is signal waveforms to show the operation of the display device shown in FIG. 1.

FIG. 3 is the display control table 33 used in the display device 100 shown in FIG. 1, and FIG. 4 is signal waveforms to show the operation of the display device 100 shown in FIG. 1. The operation of the display device 100 shown in FIG. 1 is explained below with reference to FIGS. 3 and 4.

When the image data IN is inputted to the input I/F 10, the input I/F 10 extracts a plurality of the display data, each of which is a one-line image data for the screen image, from the image data IN, and then, the input I/F 10 outputs one of the extracted display data DT, its writing line number WL indicating the line location of the outputting display data DT, and the address AD indicating the address in the memory in which the outputting display data DT is stored, sequentially. The address AD is inputted to the memory 20 and the writing line number WL is inputted to the control circuit 30. The extracted display data DT is inputted to both of the memory 20 and the control circuit 30. The operation is repeated for all of the display data DT.

A plurality of the display data DT, each of which is associated with its own address AD, are stored in the memory 20 at an area, which is designated by the address AD. The control circuit 30, the black line detector 31 detects whether or not the display data DT, which is sent from the input I/F 10, is the black line, and the detection result by the black line detector 31 is inputted to the drive current calculator 32 and the display control table 33. The following is an example for the operation described above.

When the first line of the image data IN, which may be defined as the first display data, is not the black line, the following information is written in the LINE NUMBER (SN) 1 of the display control table 33 as shown in FIG. 3.

DISPLAY OR NOT: 1
DISPLAY LINE: 1
DRIVE CURRENT (DI): 1 where "1" in the DISPLAY OR NOT means the first display data is not the black line, "1" in the DISPLAY LINE means the line number to be displayed, and "1" in the DRIVE CURRENT means the stipulated drive current for emitting the light for a single line.

When the second line of the image data IN, which may be defined as the second display data, is the black line, "0" is written for the "DISPLAY OR NOT" only in the LINE NUMBER (SN) 2 of the display control table 33, and no information for the "DISPLAY LINE" and "DRIVE CURRENT (DI) is written in time.

When the third line of the image data IN, which may be defined as the third display data, is the black line, "0" is written for the "DISPLAY OR NOT" only in the LINE NUMBER (SN) 3 of the display control table 33, and no information for the "DISPLAY LINE" and "DRIVE CURRENT (DI) is written in time.

When the fourth line of the image data IN, which may be defined as the fourth display data, is not the black line, the following information is written in the LINE NUMBER (SN) 4 of the display control table 33, initially.

DISPLAY OR NOT: 1
DISPLAY LINE: 4

At this moment, "4"s are written in the "DISPLAY LINE" in the LINE NUMBERs (SN) 2 and 3, which were blanks. Simultaneously, "⅓"s are written in the "DRIVE CURRENT (DI)" in the LINE NUMBERs (SN) 2, 3 and 4. This "⅓" information is calculated by the drive current calculator 32 in the following method.

In the drive current calculator 32, when the display data DT indicating the black line is sent to the drive current calculator 32 sequentially, the drive current calculator 32 counts the number of time (S) that the display data DT indicating the black line is sent. In the above example, the number of time (S) is 2, that is, (S=2). Then, the time period for emitting the light of the line, which comes to the next of the display data DT indicating the black line, is calculated. In the above example, the time period for emitting the light of the fourth line, which is the fourth display data, is calculated. The time period for emitting the light is calculated with the equation (S+1) wherein "1" shows the stipulated time period for emitting the light for a single line. In the above example, the time period for emitting the light of the fourth line is set at three times longer than that regular time period. Then, the drive current calculator 32 calculates the drive current applied to the second, third and fourth lines in accordance with the calculated time period for emitting the fourth line. The drive current from the power sources 52-1~**52-*n* in the column driver 50 is calculated with the equation 1/(S+1) where "1" shows the stipulated drive current for emitting the light for a single line. The calculation result is written in the DRIVE CURRENT (DI) of the display control table 33**.

When the fifth line of the image data IN, which may be defined as the fifth display data, is not the black line, "1" is written for the "DISPLAY OR NOT" only in the LINE NUM- BER (SN) 5 of the display control table 33, and since no black exists in the previous line numbers SN, "5" and "1" are written in the DISPLAY LINE and the DRIVE CURRENT (DI), respectively.

By repeating the operation described above, the display control table 33 corresponding to the display data DT in the memory 20 is completed.

The read-out operation is explained below. The row control unit 36, the column control unit 35 and the drive current control unit 38 read-out the display control information of a certain display data from the display control table 33, and outputs the display control information.

At the first scanning operation, the information of the DISPLAY LINE (DL) corresponding to the first line number SL1, which is "1", is read out and outputted as the display-line information DL having "1". Further, the information of the DRIVE CURRENT (DI) corresponding to the first line number SL1, which is "1", is read out and outputted as the drive current control signal CC having "1". The display-line information DL having "1" is sent to the decoder 41 in the row driver 40. The row switch 42-1, which corresponds to the cathode ray R1, turns on so that the cathode ray R1 is connected to the ground GND.

At the same time, a read out line number RL is applied to the address terminal A2 of the memory 20 as the control address AD2, and the first display data DT, which is the first line of the image data IN, is outputted from the output terminal D2 of the memory 20 in response to the control address AD2. The first display data is applied to the column control unit 35, and the luminance information, which is the content of the first display data DT, is converted by the column control unit 35 to the time information indicating the period for turning the column switch on. As a result, each of the column switches 52-1~**52-*n* is controlled by the control signal CS. The drive current control signal CC is inputted to the DAC 51, and the DAC 51 converts the drive current control signal CC having "1" to an analog signal. In accordance with the read-out operation descried above, the amount of the drive current from each power source 52-1~52-*n* for the first display data DT is set to the stipulated drive current. Accordingly, as shown in FIG. 4, during the time period S1, the light emitting diodes E11, E12~E1*n*, which is formed at the intersections between the cathode ray R1 and the anode rays C1~Cn, produce luminescence wherein the luminance of the light emitting diodes E11, E12~E1*n*** is determined by the time period for which the stipulated drive current is supplied.

At the second scanning operation, the information of the DISPLAY LINE (DL) corresponding to the second line number SL2, which is "4", is read out and outputted it as the fourth line number SL4. Further, the information of the DRIVE CURRENT (DI) corresponding to the second line number SL2, which is "⅓", is read out and outputted as the drive current control signal CC having "⅓". The line number SL is decoded by the decoder 41 in the row driver 40, and the decoder 41 turns on the row switch 42-4 corresponding to the cathode ray R4. As the result, the cathode ray R1 is connected to the ground GND. On the other hand, the fourth display data DT, which is the fourth line of the image data IN, is outputted from the memory 20. The luminance information, which is the content of the fourth display data DT, is converted by the column control unit 35 to the time information indicating the period for turning the column switch(es) on. In this example, the period for turning on the column switch is expanded three times longer than the stipulated period and the column switch (es) are so controlled. The drive current control signal CC having "⅓" is applied to the DAC 51, and converted to the analog signal, which controls the power source 52-1~**52-*n*. Thus, in accordance with the read-out operation descried above, the amount of the drive current from each power source 52-1~52-*n*** is set to one-third (⅓) of the stipulated drive current.

As shown in FIG. 4, during the time periods S2~S4, the light emitting diodes E41, E42~E**4*n*, which is formed at the intersections between the cathode ray R4 and the anode rays C1~Cn, produce luminescence wherein the luminance of the light emitting diodes E41, E42~E4*n* is determined by the time period (3 times longer than the stipulated period) for which the drive current (⅓ of the stipulated drive current) is supplied. Therefore, at the second scanning operation, the operation for displaying the black line on the second cathode ray R2 is not performed, and the operation for displaying the fourth display data on the fourth cathode ray R4 with the one-third drive current is performed, instead. As described above, during the scanning periods S2~S4, the fourth display data is displayed on the fourth cathode ray R4 with the one-third drive current for the time period, which is three times longer than the stipulated period. Thus, the brightness that human being feels at his eyes in the operation described above is the same as that in the conventional operation, that is, the fourth display data is displayed on the fourth cathode ray R4 with the stipulated drive current for the time period S4**.

At the third scanning operation, the information of the DISPLAY LINE (DL) corresponding to the fifth line number SL5, which is "1", is read out and outputted as the display-line information DL having "1". Further, the information of the DRIVE CURRENT (DI) corresponding to the fifth line number SL5, which is "1", is also read out and outputted as the drive current control signal CC having "1". As described above, since the DISPLAY LINE (DL) is "5" and the DRIVE CURRENT (DI) is "1", the column control unit 35 and the row control unit are operated without expanding the time period for emitting the fifth display data is not extended. That is, the light emitting diode E51~E**5*n*** corresponding to the fifth display data produce luminescence for stipulated time period.

As well as the first through third scanning operations, at the fourth scanning operation, the information of the DISPLAY LINE (DL) corresponding to the sixth line number SL6, which is "7", is read out and outputted it as the seventh line number SL7. Further, the information of the DRIVE CURRENT (DI) corresponding to the sixth line number SL6, which is "½", is read out and outputted as the drive current control signal CC having "½". Thus, as the same as the second scanning operation, the operation for displaying the black line on the sixth cathode ray R6 is not performed, and the operation for displaying the seventh display data on the seventh cathode ray R7 with the half of the stipulated drive current for twice longer than the stipulated time period is performed, instead.

By repeating the scanning operation for the image data IN, all display data DT stored in the memory 20 are displayed at the organic EL panel 1.

According to the display device 100 of the preferred embodiment of the invention, the control circuit 30 detects the black line, in which all pixels (LEDs) in one line are non-luminescence, halts the scanning operation to the black line for a particular period, and applies the time period for halting to another time period for displaying a line, which is next to the black line and which is not the black line. Thus, the time period of the line to be displayed next to the S black lines ("S" is numbers of the black line) is "S+1" times longer than the stipulated time period so that the drive current can be reduced to "1/(S+1)" of the stipulated drive current for each line. Therefore, it can be reduce the drive current passing through the light emitting diodes in the organic EL panel so that the product-lifetime of the organic EL panel is prolonged.

While the invention has been described with reference to illustrative embodiments, this description is not intended to be construed in a limiting sense. Thus, shapes, size and physical relationship of each component are roughly illustrated so the scope of the invention should not be construed to be limited to them. Further, to clarify the components of the invention, hatching is partially omitted in the cross-sectional views. Moreover, the numerical description in the embodiment described above is one of the preferred examples in the preferred embodiment so that the scope of the invention should not be construed to limit to them.

For example, (a) although the row switches 42-1~**42-*m* in the row driver 40 connect the cathode rays R1~Rm to the ground GND in the preferred embodiment, it is possible to use row switches, which may connect the cathode rays R1~Rm to the power supply voltage VDD under their off-condition. As well, it is possible to use column switches, which may connect the anode rays C1**~Cn to the ground GND under their off-condition. According to these row and column switches, since the reverse bias voltage is applied to the light emitting diodes under the off condition, producing luminescence in error can be avoided.

(b) The invention can be applied not only to the organic EL display device, but also to a display device having a passive matrix structure.

(c) Although the column driver 50 generates the drive current, which is supplied to the organic EL panel 1, by the power source 52-1~**52-*n*** in the preferred embodiment, it is possible to applied the voltage directly from the power supply voltage VDD.

Various other modifications of the illustrated embodiment will be apparent to those skilled in the art on reference to this description. Therefore, the appended claims are intended to cover any such modifications or embodiments as fall within the true scope of the invention.

We claim:

1. A display device, comprising:

a display panel having a passive matrix structure having a plurality of cathode rays, which are disposed in parallel, a plurality of anode rays which are disposed in parallel and are perpendicular to the cathode rays and a plurality of light emitting diodes disposed at each intersection of the cathode and anode rays, the display panel producing luminescence by the drive current flowed from each anode ray to a selected cathode ray via the light emitting diodes;

a memory storing image data inputted, which includes a plurality of display data, each of which indicates one-line image data of the image data, and outputting one of the display data to be displayed at the display panel, the display data corresponding to one of the cathode rays;

a column driver supplying drive current or voltage having a stipulated value or the less from power sources, which are commonly controlled by a control signal, to one or more anode rays, which are intended to be activated in response to the display data outputted from the memory;

a row driver connecting one of the cathode rays, which is designated by the display data, to a power supply voltage; and a controller detecting a black line, in which all light emitting diodes in one line are non-luminescence, counting a number of times (S) that the display data indicating the black line is sent to the display panel in serial, halting a scanning operation to the display data indicating the black line, applying the time period for halting the scanning operation to another time period for displaying display data, which are next to the display data indicating the black line and which is not the display data indicating the black line, whereby the another time period for displaying display data is set to "S+1" times longer than a stipulated time period, and sending the control signal to the column driver, which controls the column driver to set the drive current or voltage applied from the power source to a "1/(S+1)" of the stipulated value for the "S+1" time period.

2. A display device as claimed in claim 1, wherein the controller further includes a display control table including a first information indicating whether or not the display data is the black line, a second information indicating another display data to be displayed instead of the display data indicating the black line and a third information controlling the column driver by the control signal.

3. A display device as claimed in claim 1, wherein the display panel is an organic electroluminescence panel.

4. A method of displaying image data on a display panel having light emitting diodes disposed in a matrix, comprising:

storing the image data having a plurality of display data, each of which indicates one-line image data of the image data, inputted from an external device in a memory;

detecting the display data indicating a black line, in which all light emitting diodes in one line are non-luminescence, counting a number of times (S) that the display data indicating the black line is sent to the display panel in serial;

controlling a time period for displaying display data, which are next to the display data indicating the black line and which is not the display data indicating the black line, whereby the time period for displaying display data is set to "S+1" times longer than a stipulated time period; and controlling a drive current for producing luminescence for the display data to be displayed, the drive current being set to a "1/(S+1)" of a stipulated drive current.

* * * * *